US005494023A

United States Patent [19]

Kolak

[11] Patent Number: 5,494,023

[45] Date of Patent: Feb. 27, 1996

[54] BOW STRING RELEASING APPARATUS

[76] Inventor: Kevin R. Kolak, R.D. #1 Box 21E2, Elliottsburg, Pa. 17024

[21] Appl. No.: 242,358

[22] Filed: May 13, 1994

[51] Int. Cl.[6] ..... F41B 5/00

[52] U.S. Cl. ..... 124/35.2; 124/35.1; 124/32

[58] Field of Search ..... 124/90, 91, 92, 124/88, 89, 86, 23.1, 25.6, 80, 37, 31, 32, 34, 35.2, 35.1

[56] References Cited

U.S. PATENT DOCUMENTS

| | | | |
|---|---|---|---|
| 4,466,418 | 8/1984 | Jones | 124/23.1 X |
| 4,674,469 | 6/1987 | Peck | 124/32 X |
| 4,741,320 | 5/1988 | Wiard | 124/88 X |
| 5,205,268 | 4/1993 | Savage | 124/88 X |
| 5,224,463 | 7/1993 | Townsend | 124/31 X |
| 5,247,921 | 9/1993 | Todd | 124/35.1 X |

*Primary Examiner*—Kenneth J. Dorner
*Assistant Examiner*—Harry C. Kim

[57] ABSTRACT

A bow string releasing apparatus for releasing a drawn string of a bow including an activation housing for mounting to a handle of a bow. A transmitter is mounted within the activation housing for transmitting an activation signal. A grip housing can be held by an archer and engaged to a string of a bow to facilitate manual drawing of the string. A receiver is mounted within the grip housing for receiving a signal from the transmitter and effecting releasing of the string such that a hand of an archer holding the handle of the bow can be utilized to trigger releasing of the string to propel an arrow from the bow.

5 Claims, 5 Drawing Sheets

FIG 3
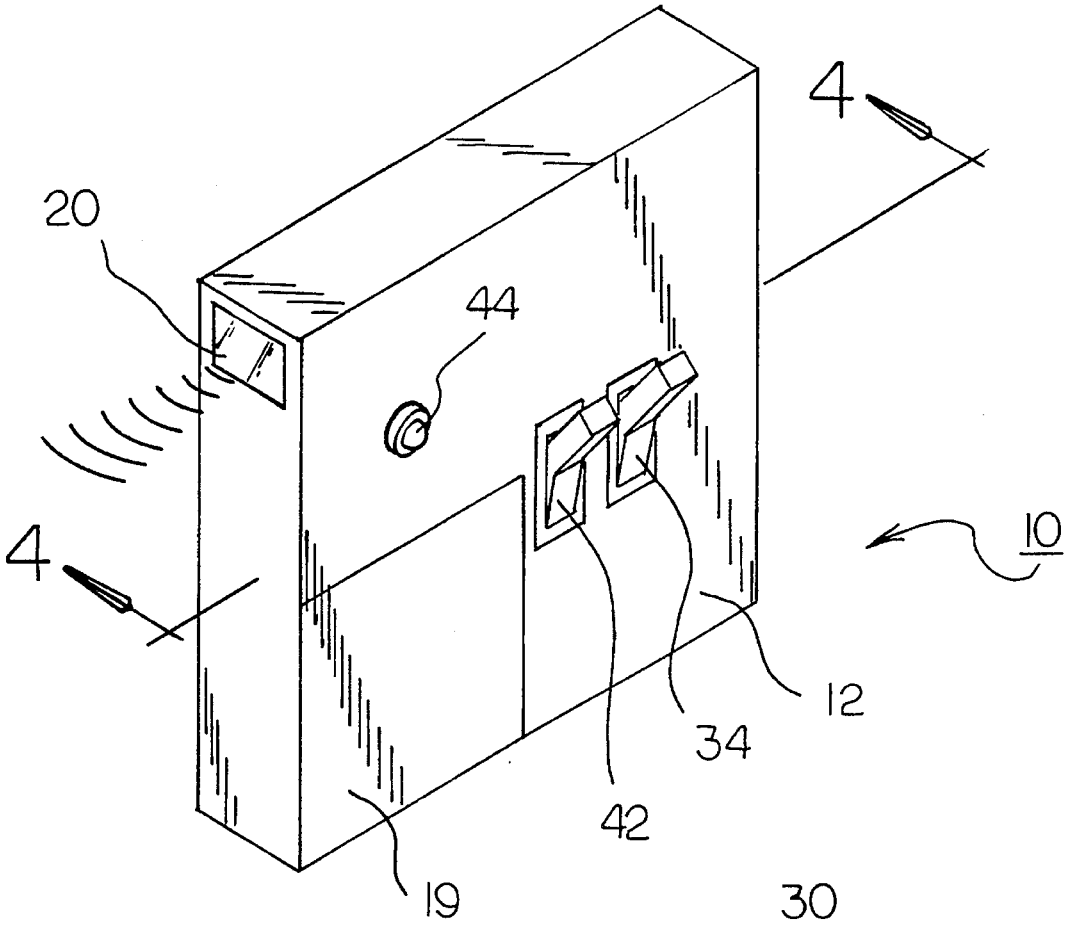
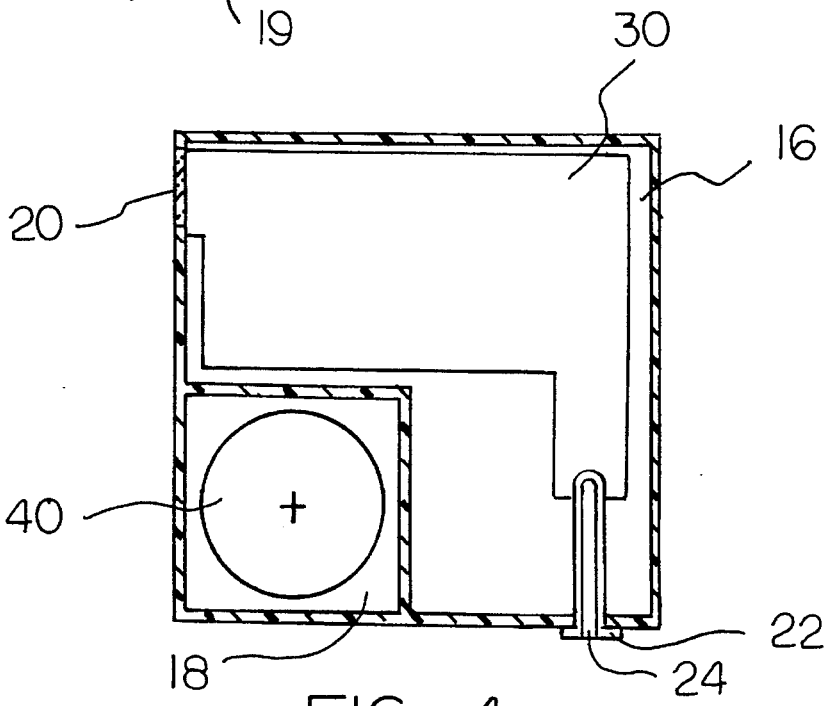
FIG 4

BOW STRING RELEASING APPARATUS

BACKGROUND OF THE INVENTION

FIELD OF THE INVENTION

The present invention relates to a bow string releasing apparatus and more particularly pertains to releasing the drawn string of a bow with a bow string releasing apparatus.

DESCRIPTION OF THE PRIOR ART

The use of bow string release mechanisms is known in the prior art. More specifically, bow string release mechanisms heretofore devised and utilized for the purpose of releasing the drawn string of a bow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,257,386 to Gazzara discloses a bow string drawing and releasing device. U.S. Pat. No. 4,316,443 to Giacomo discloses a bow string release aid. U.S. Pat. No. 4,478,202 to Anderson discloses a force multiplying archery bow. U.S. Pat. NO. 4,485,798 to Hamm discloses a bow string release. U.S. Pat. No. 4,674,469 to Peck discloses a bow string release. While these devices fulfill their respective, particular objective and requirements, the aforementioned patents do not describe a bow string releasing apparatus that utilizes a separate transmitter and receiver for electro-mechanically holding and releasing the string on a bow.

In this respect, the bow string releasing apparatus according to the present invention substantially departs from the conventional concepts and designs of the prior art, and in doing so provides an apparatus primarily developed for the purpose of releasing the drawn string of a bow.

Therefore, it can be appreciated that there exists a continuing need for new and improved bow string releasing apparatus which can be used for releasing the drawn string of a bow. In this regard, the present invention substantially fulfills this need.

SUMMARY OF THE INVENTION

In the view of the foregoing disadvantages inherent in the known types of bow string release mechanisms now present in the prior art, the present invention provides an improved bow string releasing apparatus. As such, the general purpose of the present invention, which will be described subsequently in greater detail, is to provide a new and improved bow string releasing apparatus and method which has all the advantages of the prior art and none of the disadvantages.

To attain this, the present invention essentially comprises, in combination, an essentially rigid and box-shaped activation housing adapted to be coupled to a handle of a bow with the activation housing having a transmitter cavity and a power source cavity formed therein and a transmitter window disposed thereon. A female jack is included and has a port extended from the activation housing and adapted to be mated with a male jack of an external triggering mechanism for receiving an externally generated trigger signal. A transmitter is disposed within the transmitter cavity of the activation housing and has an input coupled to the female jack for receiving the trigger signal and an output for transmitting one of a plurality of activation signals with each activation signal having a characteristic frequency. A transmitter frequency selector switch is coupled to the transmitter and extended from the activation housing with the transmitter frequency selector switch adapted to be set by an archer in one of a plurality of frequency-indicative orientations for enabling the transmitter to transmit an activation signal with a characteristic frequency as that set when a trigger signal is received at the input of the transmitter. A light-emitting diode is disposed in the transmitter cavity of the activation housing and positioned adjacent to the transmitter window with the diode having an input coupled to the output of the transmitter and an output for transmitting an illumination signal with the same characteristic frequency as an activation signal received at the input thereof. A transmitter power source is disposed within the transmitter power source cavity for energizing the transmitter. A transmitter power switch is coupled between the transmitter power source and the transmitter and extended through the activation housing with the transmitter power switch having one orientation for energizing the transmitter and another orientation for de-energizing the transmitter. An indicator lamp is coupled to the transmitter and extended through the activation housing with the indicator lamp adapted for transmitting an illuminated status signal when the transmitter is energized. A rigid grip housing is adapted to be held in a hand of an archer with the grip housing having a receiver cavity, a receiver power source cavity, and a solenoid cavity disposed therein, a handle formed thereon, a receiver window disposed thereon below the handle, a fork extended from the handle and adapted for receiving a string of a bow, and a C-shaped seat disposed upon and pivotally coupled to the fork with the seat having a closed orientation adapted for holding a bow string within the fork and an opened orientation adapted for releasing a bow string from the fork. A receiver is disposed within the receiver cavity of the grip housing and has an input for receiving an illumination signal from the transmitter through the receiver window and an output for transmitting a key signal. A receiver frequency selector switch is coupled to the receiver and extended from the grip housing with the receiver frequency selector switch adapted to be set in one of a plurality of frequency-indicative orientations by an archer for enabling the receiver to transmit the key signal at the output thereof when an illumination signal with the same characteristic frequency as that set is received at the input of the receiver. A spring-loaded solenoid is disposed within the solenoid cavity with the solenoid having an input coupled to the output of the receiver. The solenoid further includes a fixed portion and an extendable portion slidably disposed within the fixed portion with the extendable portion positionable in a retracted orientation when the key signal is present at the input and positionable in an extended orientation when the key signal is absent from the input. An elongated latch having a first end, a second end, and an intermediate location defined therebetween is included with the latch disposed within the solenoid cavity with the intermediate location pivotally coupled to the grip housing, the first end pivotally coupled to the solenoid, and the second end extended from the grip housing and abutted against the seat, the latch further having an extended orientation induced by the extended orientation of the solenoid for placing the seat in an opened orientation and a retracted orientation induced by the retracted orientation of the solenoid for allowing the seat to be placed in a closed orientation. A receiver power source is disposed within the receiver power source cavity of the grip housing for energizing the receiver and solenoid. Lastly, a receiver power switch is coupled between the receiver power source and the receiver and the receiver power source and the solenoid with the receiver power switch having one orientation for energizing the receiver and solenoid and another orientation for de-energizing the receiver and solenoid.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bow string releasing apparatus which has all the advantages of the prior art bow string release mechanisms and none of the disadvantages.

It is another object of the present invention to provide a new and improved bow string releasing apparatus which may be easily and efficiently manufactured and marketed.

It is a further object of the present invention to provide a new and improved bow string releasing apparatus which is of durable and reliable construction.

An even further object of the present invention is to provide a new and improved bow string releasing apparatus which is susceptible of a low cost of manufacture with regard to both materials and labor, and which accordingly is then susceptible of low prices of sale to the consuming public, thereby making such a bow string releasing apparatus economically available to the buying public.

Still yet another object of the present invention is to provide a new and improved bow string releasing apparatus which provides in the apparatuses and methods of the prior art some of the advantages thereof, while simultaneously overcoming some of the disadvantages normally associated therewith.

Even still another object of the present invention is to provide a new and improved bow string releasing apparatus for releasing the drawn string of a bow.

Lastly, it is an object of the present invention to provide a new and improved bow string releasing apparatus comprising a hollow activation housing adapted to be coupled to the handle of a bow having a transmitter window disposed thereon; a transmitter disposed within the activation housing with the transmitter having an input adapted for receiving an externally generated trigger signal and an output for transmitting one of a plurality of activation signals with each activation signal having a characteristic frequency; at least one light-emitting diode having an input coupled to the output of the transmitter and an output for transmitting an illumination signal through the transmitter window when an activation signal is received at the input thereof; a transmitter power source for energizing the transmitter; a transmitter power switch having one orientation for energizing the transmitter and another orientation for de-energizing the transmitter; a rigid grip housing adapted to be held in a hand of an archer having a receiver window disposed thereon; seating means coupled to the housing having a closed orientation adapted for holding a bow string and an opened orientation adapted for releasing a bow string; a receiver disposed in the grip housing having an input and an output with the output transmitting a key signal adapted for activating a solenoid when the illumination signal from the transmitter is received at the input thereof through the receiver window of the grip housing; a solenoid disposed within the activation housing having an input associated with the output of the receiver, the solenoid positionable in a retracted orientation when the key signal is present at the input and positionable in an extended orientation when the key signal is absent from the input; latch means coupled between the solenoid and the seating means with the latch means having an extended orientation induced by the extended orientation of the solenoid for placing the seating means in the opened orientation and a retracted orientation induced by the retracted orientation of the solenoid for allowing the seating means to be placed in the closed orientation; a receiver power source for energizing the receiver and solenoid; and a receiver power switch having one orientation for energizing the receiver and the solenoid and another orientation for de-energizing the receiver and the solenoid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side-elevational view of the transmitter of the preferred embodiment constructed in accordance with the principles of the present invention.

FIG. 4 is a cross-sectional view of the transmitter taken along the line 4—4 of FIG. 3.

The same reference numerals refer to the same parts through the various Figures.

DESCRIPTION OF THE PREFERRED EMBODIMENT

Figure 1:
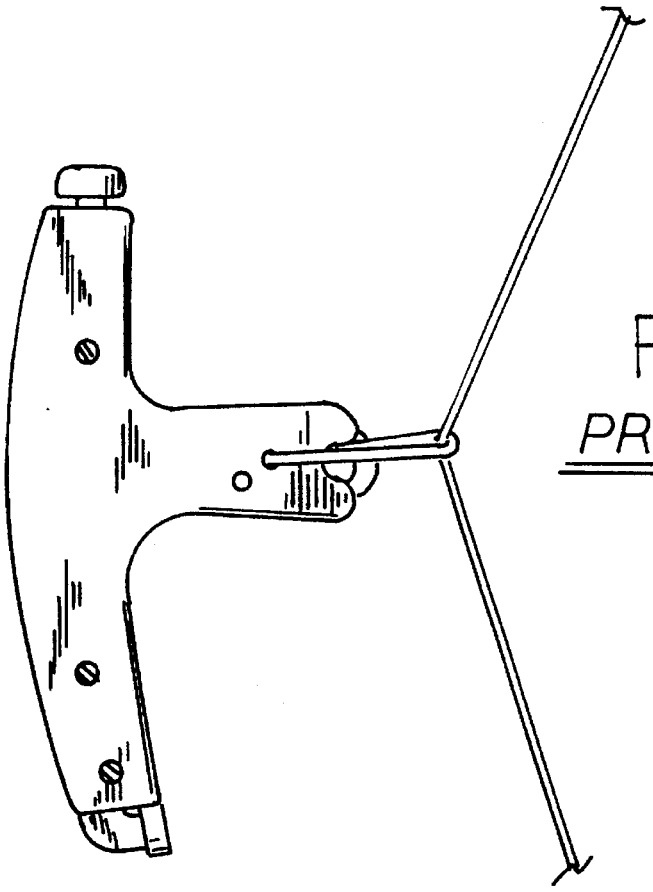
FIG 1 PRIOR ART
FIG. 1 is a side-elevational view of a prior art device coupled with a bow string in an extended position.
Figure 2:
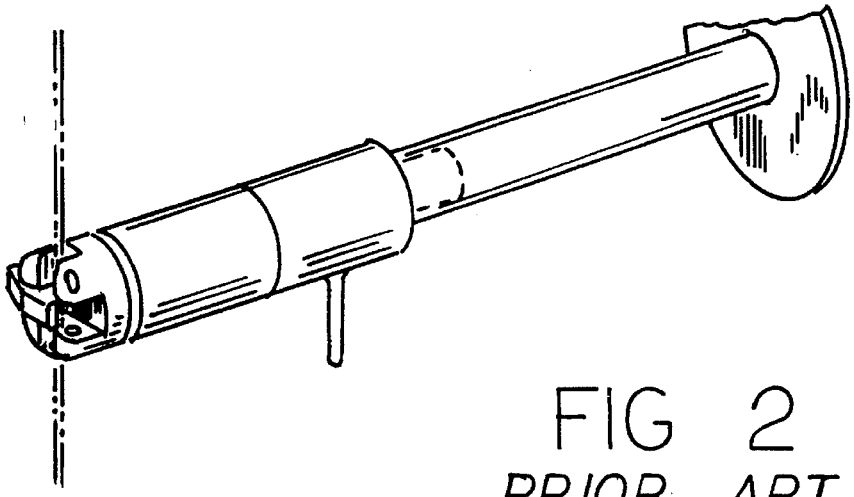
FIG 2 PRIOR ART
FIG. 2 is yet another embodiment of a prior art device coupled to the string of a bow.
Figure 5:
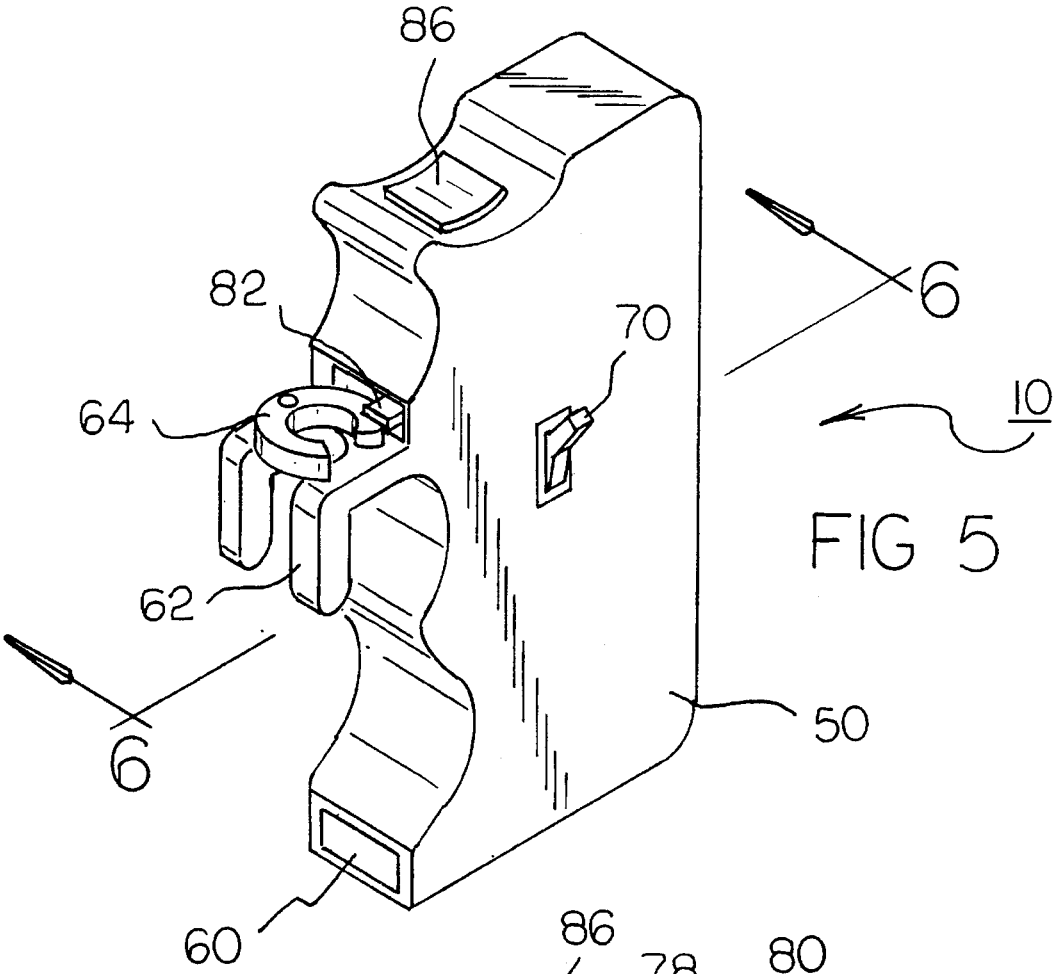
FIG. 5 is a perspective view of the receiver of the preferred embodiment constructed in accordance with the principles of the present invention.

With reference now to the drawings, and in particular, to FIGS. 3–8 thereof, the preferred embodiment of the new and improved bow string releasing apparatus embodying the principles and concepts of the present invention and generally designated by the reference number 10 will be described.

Specifically, the present invention includes fifteen major components. The major components are the activation housing, female jack, transmitter, transmitter frequency selector switch, light-emitting diode, transmitter power source, transmitter power switch, indicator lamp, grip housing, receiver, receiver frequency selector switch, solenoid, latch, receiver power source, and receiver power switch. These components are interrelated to provide the intended function.

More specifically, it will be noted in the various Figures that the first major component is the activation housing 12. The activation housing is essentially rigid and box-shaped in structure. It is adapted to be coupled to a handle 14 of a bow. The activation housing has a transmitter cavity 16 and a power source cavity 18 formed therein. A door 19 is provided for allowing access to the power source cavity. The activation housing also includes a transmitter window 20 disposed thereon. The illumination from a light-emitting diode is adapted to travel through the transmitter window.

The second major component is the female jack 22. The female jack has a port 24 extended from the activation housing 12. The female jack is adapted to be mated with a male jack 26 of an external triggering mechanism. The female jack receives an externally generated trigger signal 28 provided from the male jack. The externally generated trigger signal serves as an impetus for initiating the operation of the present invention.

The third major component is the transmitter 30. The transmitter is disposed within the transmitter cavity 16 of the activation housing 12. The transmitter has an input coupled to the female jack 22 for receiving the trigger signal 28. The transmitter also has an output for transmitting one of a plurality of activation signals 32. Each activation signal generated by the transmitter has a characteristic frequency.

The fourth major component is the transmitter frequency selector switch 34. The transmitter frequency selector switch is coupled to the transmitter 30 and extended from the activation housing 12. The transmitter frequency selector switch is adapted to be set by an archer in one of a plurality of frequency-indicative orientations. When the transmitter frequency selector switch is placed in one of these orientations, the transmitter may transmit an activation signal 32 with a characteristic frequency as that set by the archer with the transmitter frequency selector switch. This archer-selected indication signal having a characteristic frequency is then generated when a trigger signal 28 is received at the input of the transmitter through the female jack 22.

The fifth major component is the light-emitting diode 36. The light-emitting diode is disposed in the transmitter cavity 16 of the activation housing. It is positioned adjacent to the transmitter window 20. The diode has an input coupled to the output of the transmitter for receiving activation signals 32. The diode also has an output for transmitting an illumination signal 38 with the same characteristic frequency as the archer-selected activation signal 32 received at the input thereof. Therefor, when an archer desires to generate an illumination signal at a particular frequency, adjustment of the transmitter frequency selector switch 34 allows this illumination signal to be generated.

The sixth major component is the transmitter power source 40. The transmitter power source is disposed within the transmitter power source cavity 18. The transmitter power source is used for energizing the transmitter 30.

The seventh major component is the transmitter power switch 42. The transmitter power switch is coupled between the transmitter power source 40 and the transmitter 30. The transmitter power switch is extended through the activation housing 12 for access by an archer. The transmitter power switch has one orientation for energizing the transmitter. The transmitter power switch also has another orientation for de-energizing the transmitter.

The eighth major component is the indicator lamp 44. The indicator lamp is coupled to the transmitter 30 and extended through the activation housing 12. The indicator lamp is adapted for transmitting an illuminated status signal 46 when the transmitter 30 is energized. This illuminated status signal provides a visual cue to the archer indicating that the transmitter is operable.

The ninth major component is the grip housing 50. The grip housing is rigid in structure. It is adapted to be held in a hand of an archer. The grip housing has a receiver cavity 52, a receiver power source cavity 54, and a solenoid cavity 56 disposed therein. A handle 58 is integrally formed on the surface of the grip housing. The grip housing also includes a receiver window 60. The receiver window is disposed on the grip housing below the handle. The grip housing is formed of a material for allowing the transmission of an illumination signal 38 therethrough. The grip housing also includes a fork 62. The fork is extended from the handle above the receiver window. The fork is adapted for receiving a string of a bow therein. The grip housing also includes a C-shaped seat 64. The seat is disposed upon and pivotally coupled to the fork. The seat has a closed orientation adapted for holding a bow string within the fork. The seat also has an opened orientation adapted for releasing a bow string from the fork. Preferably, the handle 58 of the grip housing 50 is shaped so as to define a plurality of digit recesses directed thereinto for receiving at least a portion of digits or fingers of a human hand when the grip housing is held by a hand of an archer.

The tenth major component is the receiver 66. The receiver is disposed within the receiver cavity 52 of the grip housing. The receiver has an input for receiving an illumination signal 38 through the receiver window 60. The illumination signal received by the receiver is generated from the transmitter 30. The receiver also has an output for transmitting a key signal 68. The key signal can only be generated once the illumination signal is received.

The eleventh major component is the receiver frequency selector switch 70. The receiver frequency selector switch is coupled to the receiver 66. It is extended from the grip housing 50. The receiver frequency selector switch is adapted to be set by an archer in one of a plurality of frequency-indicative orientations. Through the use of the frequency selector switch, the receiver is able to transmit a key signal 68 at the output when an illumination signal 38 with the same characteristic frequency as that set by an archer through the receiver frequency selector switch is received at the input of the receiver. The receiver could also have its output modified such that the resulting signal is adapted for activating the solenoid. In this instance, an integral relay is formed within the receiver. The receiver can also be constructed with an output adapted for generating signals to directly control a solenoid.

The twelfth major component is the solenoid 71. The solenoid is elongated and spring-loaded in structure. The solenoid is disposed within the solenoid cavity 56. The solenoid has an input coupled to the output of the receiver 66. The solenoid further includes a fixed portion 72 and an extendable portion 74. The extendable portion is slidably disposed within the fixed portion. The extendable portion is positionable in a retracted orientation when the key signal 68 from the receiver is present at the input thereof. The extendable portion of the solenoid is also positionable in an extended orientation when the key signal is absent from the input.

The thirteenth major component is the latch 76. The latch is elongated and rigid in structure. It has a first end, a second end, and an intermediate location defined between the first end and the second end. The latch is disposed within the solenoid cavity with the intermediate location 78 and pivotally coupled to the grip housing 50. The first end 80 of the latch is pivotally coupled to the solenoid 70. The second end 82 of the latch is extended from the grip housing and abutted against the seat 64. The latch is positionable in an extended orientation induced by the extended orientation of the solenoid for placing the seat in an opened orientation. The latch is also positionable in a retracted orientation induced by the retracted orientation of the solenoid for allowing the seat to be placed in a closed orientation.

The fourteenth major component is the receiver power source 84. The receiver power source is disposed within the receiver power source cavity 54 of the grip housing. The receiver power source is adapted for energizing the receiver 66 and the solenoid 70.

Lastly, the fifteenth major component is the receiver power switch 86. The receiver power switch is coupled between the receiver power source 84 and the receiver 66. The receiver power switch is also coupled between the receiver power source and the solenoid 70. The receiver power switch is extended from the grip housing for access by an archer. The receiver power switch has one orientation for energizing the receiver and the solenoid. It also has another orientation for de-energizing the receiver and the solenoid.

In the present invention, the transmitter and receiver work in combination to allow a bow string to be released. To operate the present invention, a male jack from a remotely located triggering switch is coupled to the female jack of the present invention. The present invention can be triggered in many different ways. A draw check method can be used. When the arrow is drawn through a clicker, instead of making a noise, it closes the circuit and allows the transmitter to send a trigger signal to the receiver. A finger/thumb method may be used. The index finger or thumb of the bow hand can activate a micro switch. No movement at all is needed by the release holding hand in order to shoot an arrow. An infrared method may be used. Proximity switches may act as draw checks. When using broad heads, no sound or visible light is thus generated to spook animals. A cable stop method may be used. Any or all cable stops or draw checks can be used to trigger the infrared signal. In the preferred embodiment, a micro-switch triggerable by an archer is utilized. This micro-switch could be placed on an archer's finger and activated by movement of his finger or could be coupled between the bow handle and an arrow and operable when the arrow is retracted a certain distance from the bow handle for shooting. Alternately, a mechanism could be coupled to the cable stops on a bow for allowing the trigger signal to be generated when an arrow is placed in a shooting position. An archer selects the desired frequency for use through a frequency selector switch. Now, when a trigger signal is received and the transmitter is energized, an illumination signal is generated by the light-emitting diode.

The illumination trigger signal is transmitted towards the receiver. The receiver must be positioned in a location in a general alignment with the transmitter for receiving the illumination signal. The detector receives the illumination signal through an infrared sensitive transistor. This transistor generates a characteristic signal based upon the frequency of the illumination signal received. The characteristic signal is then received by an infrared receiver de-modulator and timer contained on a sub-miniaturized printed circuit. Based on the desired frequency selection by an archer through a selector switch on the receiver, the de-modulator generates a key signal for activating an external solenoid in a mechanical area of the grip housing. This key signal is only generated when the frequency of the illumination signal corresponds with the frequency set by the archer in the receiver. The solenoid is then activated by the key signal. The key signal places the solenoid in an extended orientation. This extended orientation pushes the latch outwards, thus allowing a bow string previously disposed within the fork and secured with the seat to be released. When the key signal is removed from the solenoid, the latch is placed in a retracted orientation. In this orientation, a bow string may be placed within the fork, and the seat pivotally rotated to secure a bow string within the fork.

The present invention uses infrared signals as a method for releasing arrows from a bow in the sport of archery. Where the traditional method of releasing arrows with fingers was advanced by mechanical release aids in the prior art, the present invention now allows a bow string to be released electro-mechanically. Although adapted for use with infrared signals, the present invention could be adapted for use with many other types of electro-magnetic signals with certain pre-selected frequencies such as radio signals or visible signals. The present invention is adapted for use primarily by tournament archers. However, the present invention performs equally well for a bow hunter.

Figure 8:
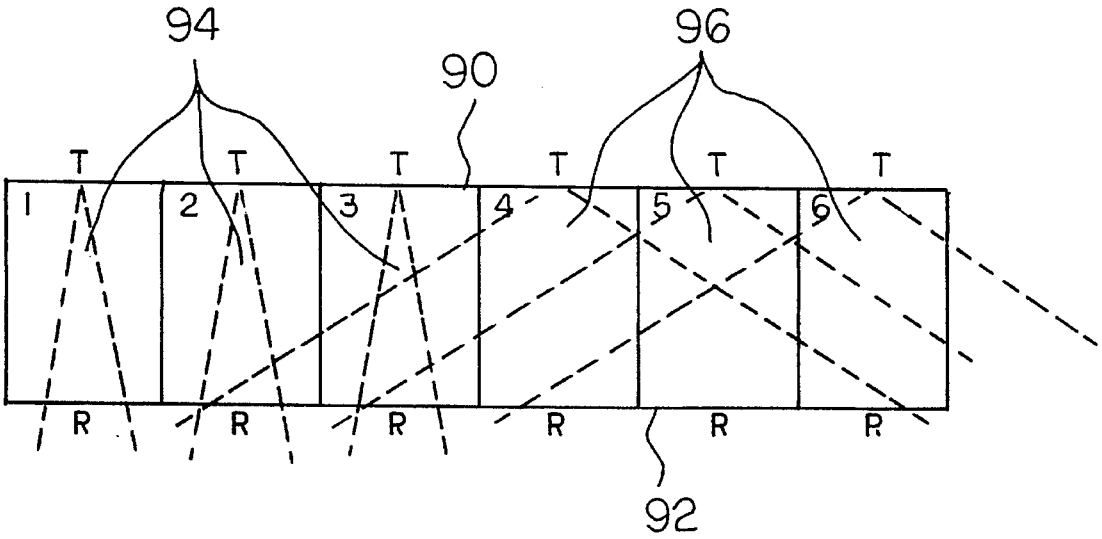
FIG. 8 is a schematic view of a typical tournament arrangement utilizing the present invention.
Figure 9:
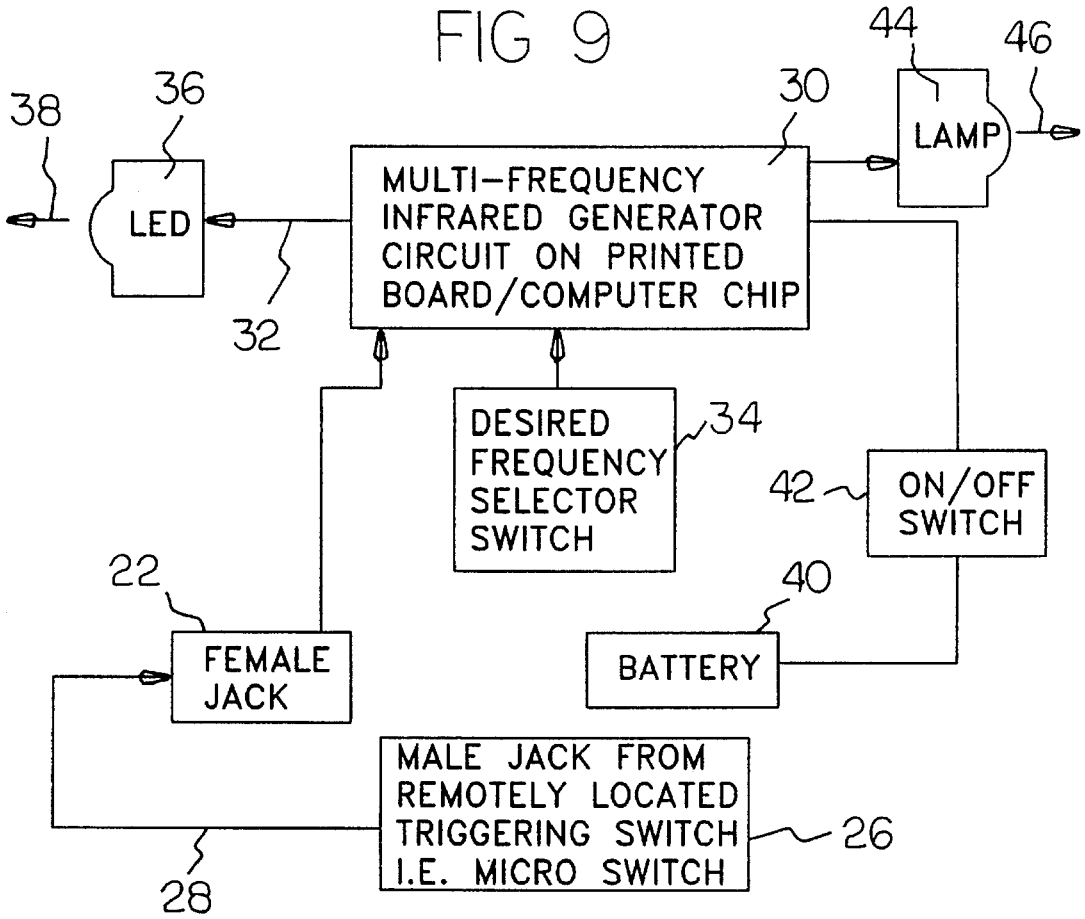
FIG. 9 is a functional block diagram of the transmitter of the present invention.
Figure 10:
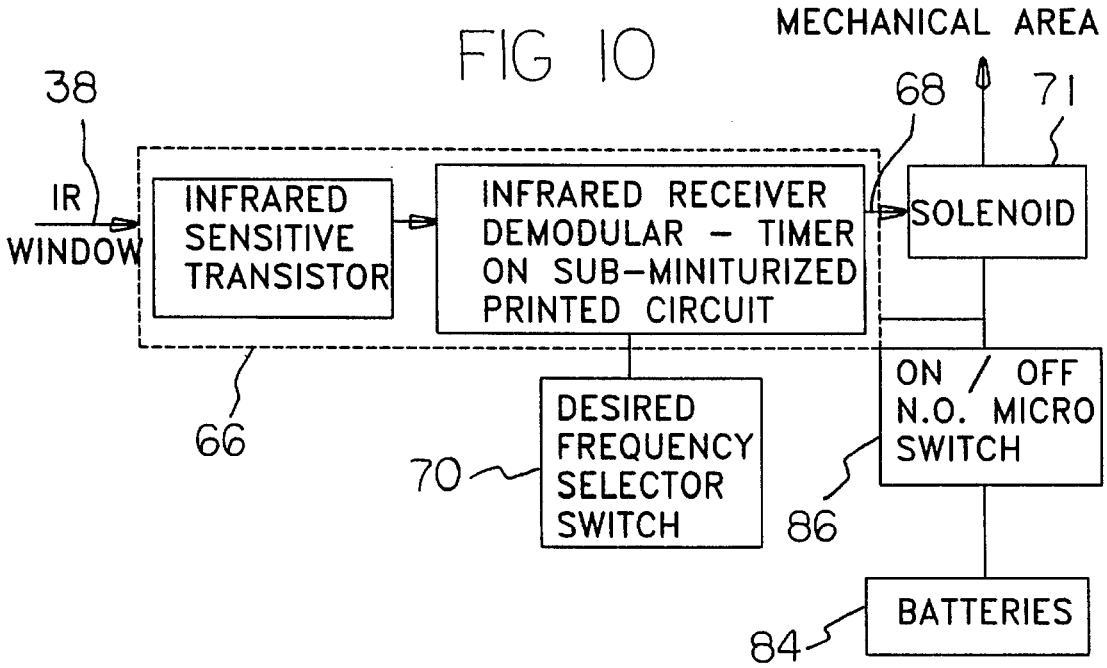
FIG. 10 is a functional block diagram of the receiver of the present invention.

The function of the transmitter is to send an IR signal to the receiver that will not interfere with the illumination signals of the transmitter or receiver on either side as shown in FIG. 8. Like many prior art remote control units, it has the capability of transmitting several user-selectable frequencies. The IR transmitter is shown in FIG. 3 is sized with dimensions of about ⅜"×1 ½"×1 ½" or smaller. This includes the transmitter power source cavity. In the preferred embodiment, a battery is utilized as the power source. The battery is capable of supplying enough power to allow the transmitter to provide thousands of transmissions. Each transmission lasts long enough for the receiver to activate a solenoid. The transmitter turns off automatically, even if the transmitter power switch remains closed. The transmitter is fitted with one or two miniature female jacks to allow for various methods of triggering with an external triggering switch. The triggering switch is positionable up to 12" away from the transmitter.

The transmitter is designed to transmit a illumination signal in a beam a distance of about 48" with the diameter of the beam being no greater than 12" in diameter at the receiver and no less than 6" in diameter at the receiver. The reason for the 12 inch diameter is to avoid triggering the competitor on either side as shown in FIG. 8. The 6 inch diameter is adapted to allow for transmission through a window so that the hand-held receiver can be aligned differently by each competitor. The transmitter is designed to transmit an infrared or near-infrared illumination signal at several frequencies. The frequency is adjustable through the transmitter frequency selection switch. This switch is step adjustable by screwdriver, through click adjustments, or a similar method. The duration of the illumination signal being transmitted is to be limited to the time it takes to activate the receiver. Regardless of how long the triggering switch is closed, the turns off automatically after the solenoid has been activated. A timing chip coupled with the receiver circuitry can be used for performing this function. The automatic shut-off function avoids having the transmitter activated and possibly activating a neighboring competitor's bow string releasing apparatus. The automatic shut-off feature also saves power by only being on for very short periods of time. Every time a illumination signal is needed, the triggering switch is closed by the competitor and the IR transmitter sends a illumination signal pulse to the receiver, then automatically turn off. If the LED is recessed ½" back into the activation housing and away from the transmitter window, it may reduce the need for collimating lenses in order to obtain the 6" and 12 inch conical beam dimensions.

Figure 6:
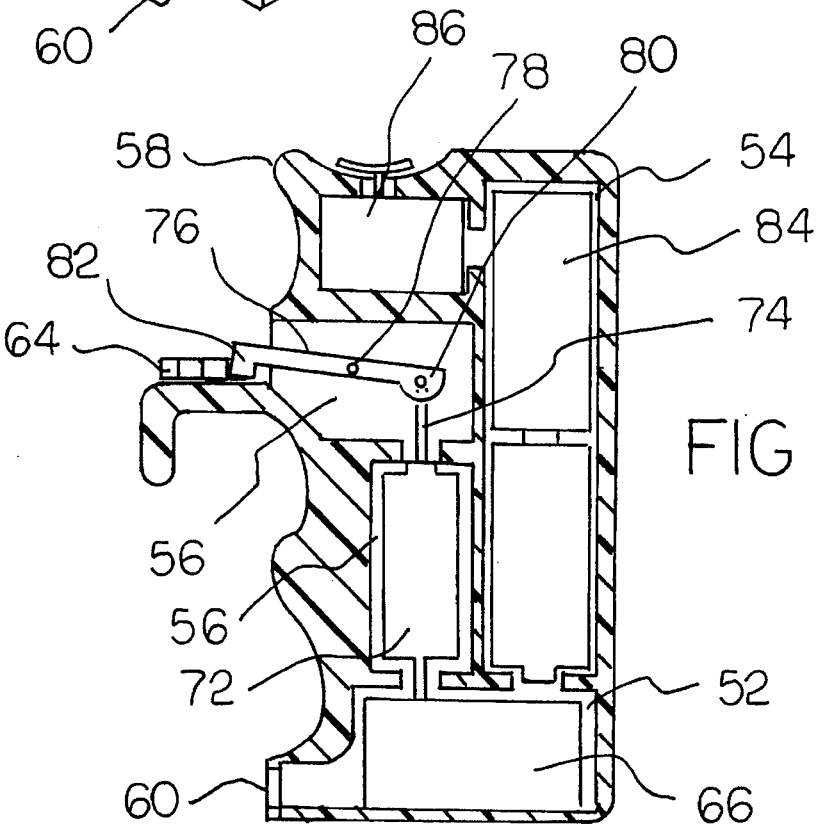
FIG. 6 is a cross-sectional view of the receiver taken along the line 6—6 of FIG. 5.
Figure 7:
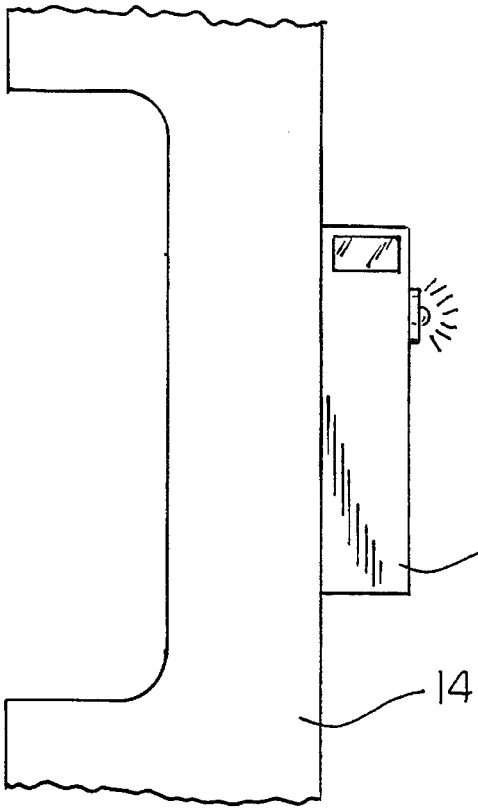
FIG. 7 is an enlarged side-elevational view depicting the coupling of the transmitter to the handle of a bow.

The function of the receiver is to receive the IR illumination signal and activate a relay which in turn energizes a solenoid that performs its designated duty. The receiver is located in a grip housing that is hand-held with limited internal space. As shown in FIG. 6, the depth of the grip housing is about ¾".

The solenoid operates at 6 volts with a draw of 250 ma. Guardian TP-3.5×9 is the model of the solenoid. A total of about 2 ounces of force at about a 3/16" stroke is delivered to the moving parts of the solenoid. The solenoid cavity is machined to contain the solenoid. The approximate size of the solenoid is about 0.438" in diameter by about 1.41" long.

The relay operates at 6 volts with a draw of 100 ma. A Radio Shack model 275-240 is used in the preferred embodiment. This relay measures 11/32" by about ⅜" by about ¼". This item is to be included as part of the receiver circuitry.

The power source is comprised of 2 lithium batteries, Radio Shack model 23-155. They are 3 volts×1300 mah each in series for a total of 6 volts×1300 mah. The size of the receiver power source cavity is about ⅝" wide by about 2 ⅞" long by about ⅝" deep (the 2 batteries are positioned end to end).

In the receiver, micro switch is utilized but an be substituted with a similar albeit smaller micro switch. The NO (Normally Open) contacts are utilized. This switch is only used to power-up the receiver. Without it, it would be on all the time. Radio Shack model 275-016 with ¾" latch is utilized in the preferred embodiment.

The IR receiver window measures about ⅛" by about ½". By extending the window to the dotted line, and keeping the photo transistor back (approximately ½" from the receiver window), it should have the same effect as using lenses and the exact opposite as the transmitter.

FIG. 8 shows the conditions that would most likely cause the archer concern of malfunction by having his/her receiver pick-up a neighboring signal. This is not as great of a concern for bow hunters as it is for the tournament archer. In FIG. 8, each archer on the shooting line is using the present invention. The squares numbered 1 through 6 represent 6 archers on the shooting line. The T at the top of each box 90 represents the transmitter that is attached to each archers bow. The R at the bottom of each box 92 represents the hand-held grip housing that contains the receiver. The dashed line that begins from one point under each T and gets wider as it approaches the R shows the path in which the IR signal is transmitted. The restricted (narrower) field of view 94 for archers 1–3, when the IR nears the receiver R, is a key in helping to eliminate over running signals from neighboring transmitters, should they happen to be on the same frequency. Archers 1–3 indicate the desired IR path while archers 4–6 show poor IR paths 96 or an undesired signals. As depicted by the diagram, the only thing not typical in real life is the sizes of each archer. This diagram shows everybody as being the same size. In reality, these sizes vary drastically.

In the preferred embodiment, the activation housing is 1 ½" wide by about 1 ½" high by about ⅜" in diameter. The overall size of the receiver is 3 ¾" wide by about ¾" thick by about 2 ¾" deep. The power source cavity of the transmitter is ⅝" wide by about 2 ⅞" long by about ⅝" diameter. The receiver cavity is about ⅝" wide by about 1 ¼" long by about ⅝" diameter. The window of the receiver is about ⅛" wide by about ½" high. The portion of the solenoid cavity containing the solenoid is ½" wide by about 1 ½" long by about 1 ½" deep. The portion of the solenoid cavity containing the latch is 9/16" wide by about 2" long by about ⅝" diameter. The receiver power switch is 7/16" wide by about ⅞" long by about ¼" deep. The size of the solenoid is ¼" wide by about ⅜" long by about 11/32" deep.

In summary, the present invention is designed for use with a bow in the sport of archery for the purpose of automatically releasing an arrow without influencing its path with the hand that draws the bowstring. It is comprised of a transmitter, which emits infrared rays and a receiver which is integrated with a "mechanical release aid." The transmitter is miniaturized and includes a battery compartment and an external triggering switch. It is mounted directly to the gripping area of the bow so that the switch can be actuated with the same hand that holds the bow. The receiver includes a reception window, a solenoid, a microswitch, an electro/mechanical relay and a timer. It is contained in a grip-shaped housing along with the mechanical release. In use, one simply draws the bow string in a conventional fashion and, when ready, actuates the triggering switch. This emits a timed beam to the receiver which activates the solenoid and the arrow is released. All of this is accomplished using only one hand—the one that holds the bow. The arrow is not subjected to any inadvertent motion of the other hand which can only serve to divert its path. The timed-release of the beam ensures that the arrow of an adjacently standing archer will not also be released, since the beam is concentrated on the intended receiver for only a short period of time. This occurrence can also be obviated by controlling the size of the beam or utilizing different frequencies along a standing line of archers. The present invention is designed for use predominately in archery tournament competitions and would be used in the "unlimited class". However, it is also a very effective aid for bow hunters. In this application, at least one state has already ruled that this electro-mechanical device is nothing more that a variation of a mechanical release and, therefore, authorized for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bow string releasing apparatus for releasing a drawn string of a bow comprising, in combination:

an essentially rigid and box-shaped activation housing adapted to be coupled to a handle of the bow with the activation housing having a transmitter cavity and a power source cavity formed therein and a transmitter window disposed thereon;

a female jack having a port extended from the activation housing and adapted to be mated with a male jack of an externally generated trigger signal;

a transmitter disposed within the transmitter cavity of the activation housing and having an input coupled to the female jack for receiving the trigger signal and an output for transmitting one of a plurality of activation signals with each activation signal having a characteristic frequency;

a transmitter frequency selector switch coupled to the transmitter and extended from the activation housing with the transmitter frequency selector switch adapted to be set by an archer in one of a plurality of frequency-indicative orientations for enabling the transmitter to transmit one of the activation singnals with the characteristic frequency as that set when the trigger signal is received at the input of the transmitter;

a light-emitting diode disposed in the transmitter cavity of the activation housing and positioned adjacent to the transmitter window with the diode having an input coupled to the output of the transmitter and an output for transmitting an illumination signal with the same characteristic frequency as one op the activation signals received at the input thereof;

a transmitter power source disposed within the transmitter power source cavity for energizing the transmitter;

a transmitter power switch coupled between the transmitter power source and the transmitter and extended through the activation housing with the transmitter power switch having one orientation for energizing the transmitter and another orientation for de-energizing the transmitter;

an indicator lamp coupled to the transmitter and extended through the activation housing with the indicator lamp adapted for transmitting an illuminated status signal when the transmitter is energized;

a rigid grip housing adapted to be held in a hand of an archer with the grip housing having a receiver cavity, a receiver power source cavity, and a solenoid cavity disposed therein, a handle formed thereon, a receiver window disposed thereon below the handle, a fork extended from the handle and adapted for receiving a string of a bow, and a C-shaped seat disposed upon and pivotally coupled to the fork with the seat having a closed orientation adapted for holding a bow string within the fork and an opened orientation adapted for releasing a bow string from the fork;

a receiver disposed within the receiver cavity of the grip housing and having an input for receiving the illumination singnal from the diode through the receiver window and an output for transmitting a key signal;

a receiver frequency selector switch coupled to the receiver and extended from the grip housing with the receiver frequency selector switch adapted to be set in one of a plurality of frequency-indicative orientations by the archer for enabling the receiver to transmit the key signal at the output thereof when the illumination signal with the same characteristic frequency as that set is received at the input of the receiver;

a relay disposed within the solenoid cavity and having an input and an output with the input adapted for receiving the key signal and an output adapted for transmitting a modified key signal adapted for activating a solenoid;

a spring-loaded solenoid disposed within the solenoid cavity, the solenoid having an input coupled to the output of the relay, the solenoid further having a fixed portion and an extendable portion slidably disposed within the fixed portion with the extendable portion positionable in a retracted orientation when the modified key signal is present at the input and positionable in an extended orientation when the modified key signal is absent from the input;

an elongated latch having a first end, a second end, and an intermediate location defined therebetween with the latch disposed within the solenoid cavity with the intermediate location pivotally coupled to the grip housing, the first end pivotally coupled to the solenoid, and the second end extended from the grip housing and abutted against the seat, the latch further having an extended orientation induced by the extended orientation of the solenoid for placing the seat in an opened orientation and a retracted orientation induced by the retracted orientation of the solenoid for allowing the seat to be placed in a closed orientation;

a receiver power source disposed within the receiver power source cavity of the grip housing for energizing the receiver and the solenoid; and a receiver power switch coupled between the receiver power source and the receiver and the receiver power source and the solenoid with the receiver power switch having one orientation for energizing the receiver and the solenoid and another orientation for de-energizing the receiver and the solenoid.

2. A bow string releasing apparatus for releasing a drawn string of a bow, the apparatus comprising:

electrically energizable transmitter means mountable to a handle of the bow for generating and radiating an activation signal;

a grip housing "having hand holding means thereon for allowing the grip housing to be gripped by" a human hand;

seating means coupled to the grip housing for selectively securing and releasing the bow string; and electrically energizable receiver means mounted within the grip housing for receiving said activation signal and operating said seating means in response thereto, whereby the seating means "is adapted to engage the bow string to allow the bow string to be manually pulled back to a drawn position, whereby the transmitter means is activated to transmit the activation signal to the receiver means to activate the seating means to release the string to a released position."

3. The bow string releasing apparatus of claim 2, wherein the hand holding means is defined by a handle having a plurality of digit recesses directed thereinto for receiving at least a portion of digits of the human hand.

4. The bow string releasing apparatus of claim 3, wherein the transmitter means includes a transmitter frequency selector means for selecting one of a plurality of frequencies of the activation signal for generation and radiation from the transmitter means.

5. The bow string releasing apparatus of claim 4, wherein the receiver means includes a receiver frequency selector means for selecting the one of the plurality of frequencies of the activation signal for reception and operation of said seating means in response thereto.

* * * * *